US006715335B2

(12) United States Patent
Huebner et al.

(10) Patent No.: US 6,715,335 B2
(45) Date of Patent: Apr. 6, 2004

(54) PORTABLE CRIMPING DEVICE FOR CRIMPING FITTING SOCKETS

(75) Inventors: Kenneth L. Huebner, Mantua, OH (US); Thomas B. Lininger, Mantua, OH (US); Benjamin M. Trace, Mogadore, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 44 days.

(21) Appl. No.: 10/177,593

(22) Filed: Jun. 20, 2002

(65) Prior Publication Data

US 2003/0196471 A1 Oct. 23, 2003

Related U.S. Application Data

(60) Provisional application No. 60/300,279, filed on Jun. 22, 2001.

(51) Int. Cl.[7] ..... B21D 41/00; B21J 7/16

(52) U.S. Cl. ..... 72/402; 72/453.16; 72/455; 72/463

(58) Field of Search ..... 72/399, 402, 444, 72/455, 453.16, 462, 463; 29/237

(56) References Cited

U.S. PATENT DOCUMENTS

| | | | | |
|---|---|---|---|---|
| 3,851,514 A | | 12/1974 | Chen et al. | |
| 3,858,298 A | | 1/1975 | Whitledge et al. | |
| 4,033,022 A | | 7/1977 | Currie et al. | |
| 4,309,892 A | | 1/1982 | Currie | |
| 4,357,822 A | * | 11/1982 | Patel | 72/402 |
| 4,515,006 A | | 5/1985 | Stanley | |
| 4,703,643 A | * | 11/1987 | Brooks et al. | 72/402 |
| 4,773,249 A | * | 9/1988 | Hoff et al. | 72/402 |
| 4,781,055 A | | 11/1988 | Phipps | |
| 4,953,383 A | | 9/1990 | Stiver et al. | |
| 5,253,506 A | * | 10/1993 | Davis et al. | 72/402 |
| 5,297,417 A | | 3/1994 | Orcutt et al. | |
| 5,437,177 A | | 8/1995 | Orcutt et al. | |
| 6,125,681 A | | 10/2000 | Orcutt et al. | |

* cited by examiner

*Primary Examiner*—Ed Tolan
(74) *Attorney, Agent, or Firm*—Joseph J. Pophal

(57) ABSTRACT

A portable, hand held, apparatus for crimping a hose fitting to the end of a hose, including a unitary frame having four sides surrounding an open middle section, wherein one of the sides is a base with a receiving opening extending therethrough for housing crimping componentry and another of the sides is a top portion for attaching a cylinder, piston, and a pusher. The outer surface of each of the remaining two sides has mounting holes for attaching a power unit. The unitary frame includes a handle for manual lifting purposes, and has multiple support surfaces enabling the crimping apparatus to be variably positioned during the crimping process. The unitary frame also includes blind mounting holes on three sides for attaching various mounting brackets, thus enabling the apparatus to be oriented in any desired angular position during the noted crimping process.

24 Claims, 10 Drawing Sheets

PORTABLE CRIMPING DEVICE FOR CRIMPING FITTING SOCKETS

CROSS-REFERENCE TO RELATED CASES

The present application claims the benefit of the filing date of U.S. Provisional Application Serial No. 60/300,279; filed Jun. 22, 2001.

FIELD OF THE INVENTION

This invention relates to an apparatus for crimping hose fittings onto the ends of hoses, and more particularly to a portable, preferably hand held, crimping device.

BACKGROUND OF THE INVENTION

Crimping machines or apparatuses are well known devices or mechanisms used for permanently crimping the cylindrical socket of a hose fitting onto the end of a hose. Initially, the cylindrical socket of the hose fitting has an inner diameter slightly larger than the outer diameter of the hose, thus allowing the hose to be inserted into the cylindrical socket. The end of the hose and fitting are inserted into the crimping machine that holds a crimping die segment assembly. The die segment assembly is radially contracted and compresses the socket onto the hose to a predetermined diameter.

To accomplish this crimping operation, a typical crimping machine is provided with a power source, such as a hydraulic pump, that supplies pressurized hydraulic fluid to a cylinder having a movable piston disposed therein. When pressurized fluid is supplied to the cylinder, the piston moves from a first position to a second position. A die pusher is connected to the piston and moves with the piston. During this movement, the die pusher comes in contact with a die ring that rests on top of the radially aligned die segment assembly. The die segment assembly is housed within a tapered die bowl and the die segment assembly radially contracts as it moves deeper into the die bowl. As the piston moves to the second position, the die segment assembly travels into the tapered die bowl, radially contracting, and crimps the fitting socket via the permanent deformation thereof. Due to forces from the transmission of hydraulic power, the longitudinal movement of the piston and die pusher, and the radial contraction of the die segment assembly, the structure of the crimping machine is subjected to various stresses. Therefore this structure must be rigid in order to withstand these stresses and produce a precise crimp diameter.

Typically the structure for the crimping machine is comprised of a lower base plate, an upper end plate and four column rods interconnecting both plates. Examples of a crimping machine with this structure are shown in U.S. Pat. No. 3,851,514 to Chen et al., U.S. Pat. No. 4,781,055 to Phipps, and U.S. Pat. No. 4,515,006 to Stanley. As discussed previously, forces from the power transmission and movement of the componentry can cause stresses to the structure of the crimping machine. These stresses can adversely affect the linkages between the plates and column rods, thus creating fatigue failures.

Certain crimping machines are used in hose assembly fabrication facilities and are permanently affixed to a flat surface, such as a workbench, either in a horizontal or vertical angular orientation. These types of machines are large, heavy, and the weight is not evenly distributed. This may cause a top-heavy machine to tip over during operation unless permanently affixed. An example of this type of crimping machine, shown in U.S. Pat. No. 4,309,892 to Currie, has such a vertical orientation. Therefore, this type of machine must be must be affixed to a support structure and is not easily transported to different locations.

Portable crimping machines are used for those applications where crimping cannot take place in a hose assembly fabrication facility. These types of machines are typically lighter and smaller than those permanently affixed. Portable crimping machines are generally vertically oriented. A base, having a flat lower surface, is provided for setting the machine on a flat horizontal surface. Portable crimping machines typically have side walls or columns that are removably attached to the top and bottom plates. Examples of portable crimping machines with this design are shown in U.S. Pat. Nos. 5,437,177 and 6,125,681, both to Orcutt et al. Like permanently affixed crimping machines, forces from the power transmission and movement of the componentry can also cause stresses in the side walls and columns of portable crimping machines, creating fatigue failures in the linkages.

Certain portable crimping devices provide handles for manual lifting. Examples of crimping machines with this feature include the above mentioned U.S. Pat. Nos. 5,437,177 and 6,125,681 to Orcutt et al. Due to the size and weight of these types of crimping devices, the portability thereof is quite limited.

Portable crimping machines of the variety previously discussed have a structure that is likely to be damaged if the machine is dropped or topples over. These machines can be top heavy and unbalanced, lending themselves to tipping over. If this occurs, the linkages between the side walls and plates can break, or the structure becomes misaligned. Any misalignment will negatively affect the precision of the crimping process and the reliability of the crimping machine.

SUMMARY OF THE INVENTION

The present invention provides a portable apparatus for crimping a hose fitting onto the end of a hose. This invention overcomes the obstacle of providing a crimping apparatus having a housing comprised of more than one structural element. A crimper housing with more than one structural element contains stress points localized at the junctions of these elements. These junctions are typically the failure points when crimper housings are damaged due to excessive stresses and strains.

A feature of the present invention is to provide a hand held, portable crimper comprising a unitary frame having a longitudinal axis and four sides surrounding an open middle section, one of the sides being a base, located at one end of the middle open section, perpendicular to the longitudinal axis, and having a receiving opening longitudinally extending through. A top portion of the unitary frame, also perpendicular to the longitudinal axis, is located at the opposite end of the open middle section from the base. A first side, parallel with the longitudinal axis, is perpendicular to and interconnects the base and top portion. A second side, also parallel with the longitudinal axis and perpendicular to the base and top portion, is located at the opposite side of the open middle section from the first side and also interconnects the base and top portion.

The portable crimper also includes componentry, such as a cylinder, removably attached to an inner surface of the top portion, and a piston that is movable longitudinally from a first position to a second position within the cylinder. A pusher is removably attached to the piston, and has a hollow end portion. A removable annular die bowl is located within the receiving opening in the base. An annular die separator, having a base portion located adjacent to the die bowl and a series of angular extensions protruding from the base portion, is positioned within the die bowl. An annular die segment assembly is removably positioned on top of the die separator and includes a plurality of die segments which are radially movable relative to the base receiving opening. The die segments have a generally flat upper portion and an angular lower portion adapted to mate with the angular extensions of the annular die separator. An annular die ring is disposed between the pusher and the die segment assembly.

The unitary frame of the noted apparatus may further have mounting holes on at least one of the outer surfaces of the first and second side for attaching a power unit or for attaching a mounting plate. The unitary frame may also have blind mounting holes on the outer surface of the base portion for also attaching a mounting plate. Another feature of the present invention includes being able to orient the apparatus in any desired angular position during the crimping of the hose fitting to the hose. The mounting plates of the present invention also overcome the obstacle of locating an available flat surface for resting the crimping apparatus thereupon in order to support the abutting flat surface of the crimping apparatus.

The unitary frame of the noted apparatus may also include a handle, located longitudinally outward of the top portion, for manual lifting purposes. The handle can be integral with the unitary frame.

Another feature of the present invention includes having a portable crimping apparatus as previously set forth, wherein the unitary frame includes multiple support surfaces enabling the longitudinal axis to be angularly positioned either horizontally or vertically during the crimping of the hose fitting to the hose. The base, first side and second side of the unitary frame may further have a generally flat outer surface so that the noted apparatus can be placed on either the base, first side or second side during the crimping of the hose fitting to the hose.

A further attribute of the present invention includes having a portable crimping apparatus as previously set forth, wherein the first and second side of the unitary frame are comprised of solid, essentially unapertured surfaces.

Another feature of the present invention includes having the unitary frame of the crimping apparatus preferably taking the form of a light metal casing. The unitary frame may be formed from a non-metallic material, or it may be comprised of a casting of a light metal alloy, such as of aluminum.

Still, another attribute of the present invention includes having a portable crimping apparatus, as previously set forth, wherein the pusher includes a mechanism for cutting hose.

Another feature of the present invention includes having the size and weight selected in order to make the apparatus readily portable and capable of being hand-carried to remote locations by a human operator.

Further features of the present invention will become apparent to those skilled in the art upon reviewing the following specification and attached drawings.

DETAILED DESCRIPTION OF THE PREFERRED EMBODIMENT

Figure 1:
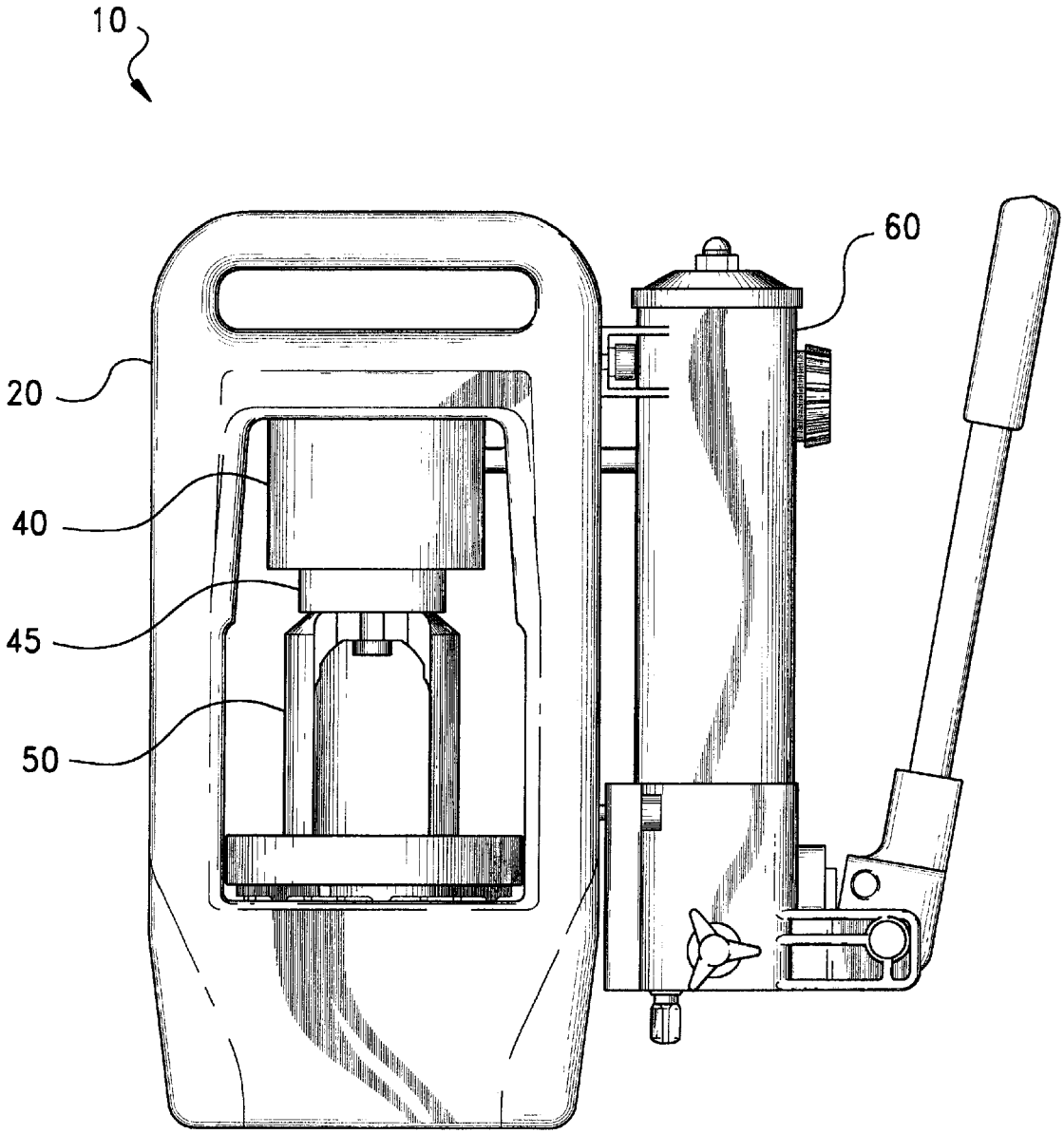
FIG. 1 is a front, elevational view of a portable crimping device in accordance with the invention.
Figure 14:
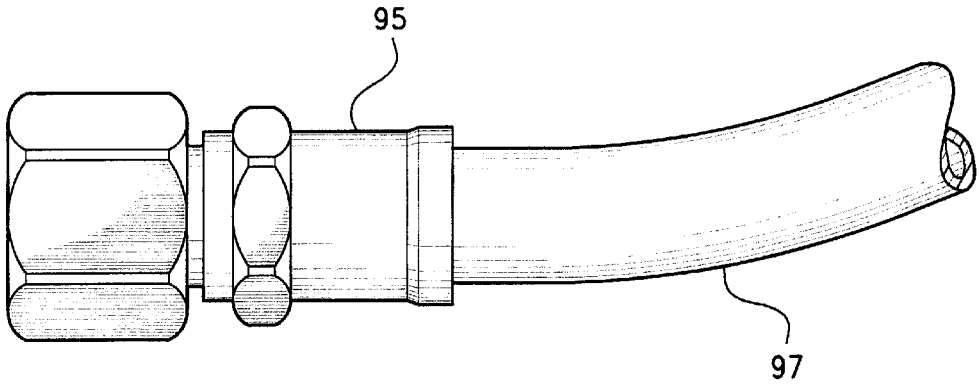
FIG. 14 is a side elevational view of the hose and hose fitting of a typical hose assembly.

Referring now to FIG. 1, there is illustrated a portable and preferably hand held crimping device, indicated generally at 10, for crimping fitting sockets onto hydraulic hose ends. The portable (hand held) crimping device 10 includes a one-piece crimper housing 20, a hydraulic cylinder 40, a spring-loaded piston 45 movably situated inside the hydraulic cylinder 40, a removable die pusher 50, and an attachable manually operated hydraulic pump 60. The portable crimping device 10 is utilized for permanently attach a fitting 95 onto the end of a hose 97, as shown in FIG. 14 in a manner well known in the art.

Figure 2:
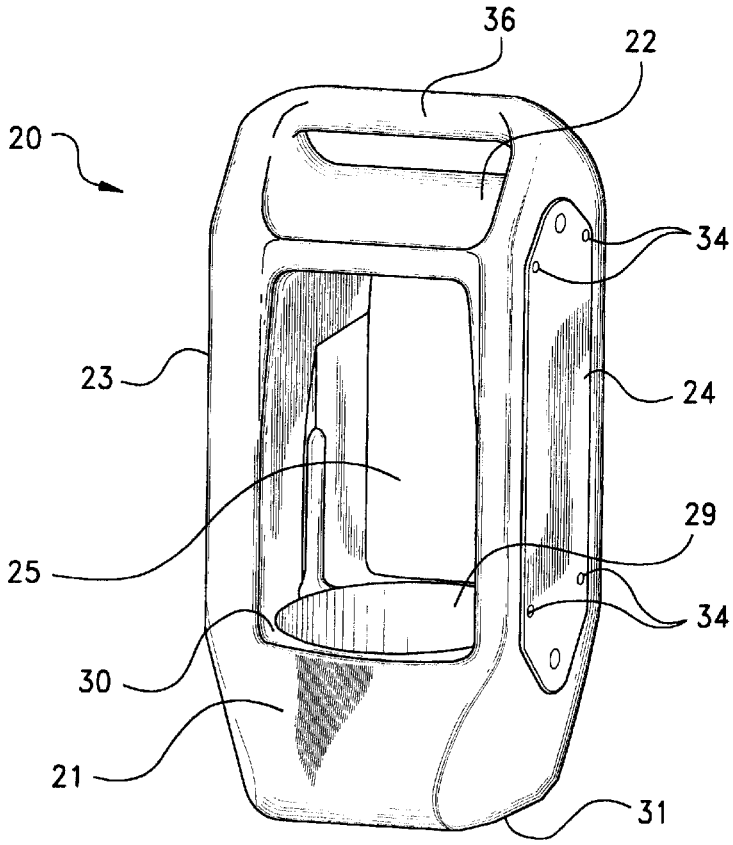
FIG. 2 is a perspective view illustrating a crimper housing in accordance with the present invention.
Figure 3:
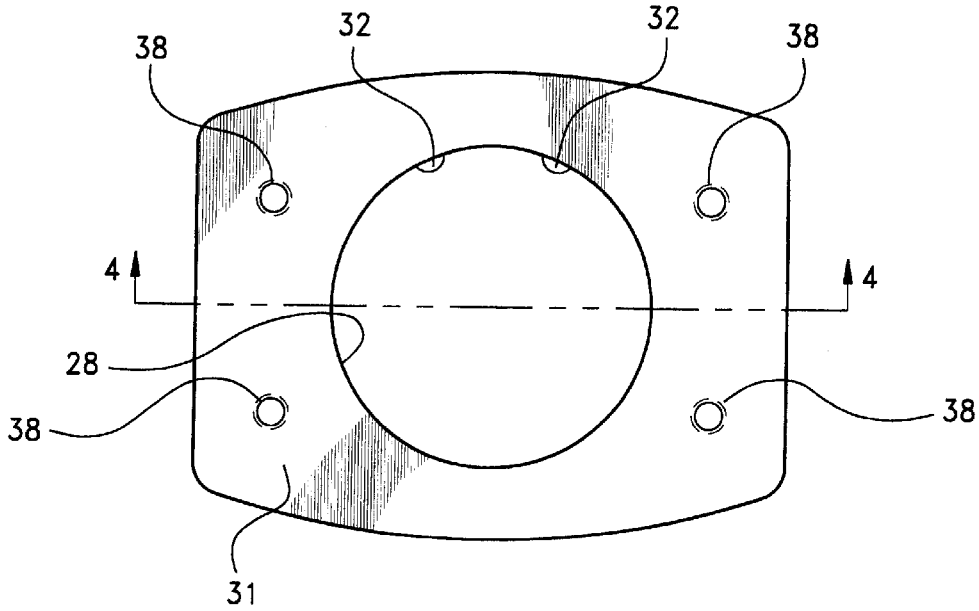
FIG. 3 is a bottom view of the crimper housing.
Figure 4:
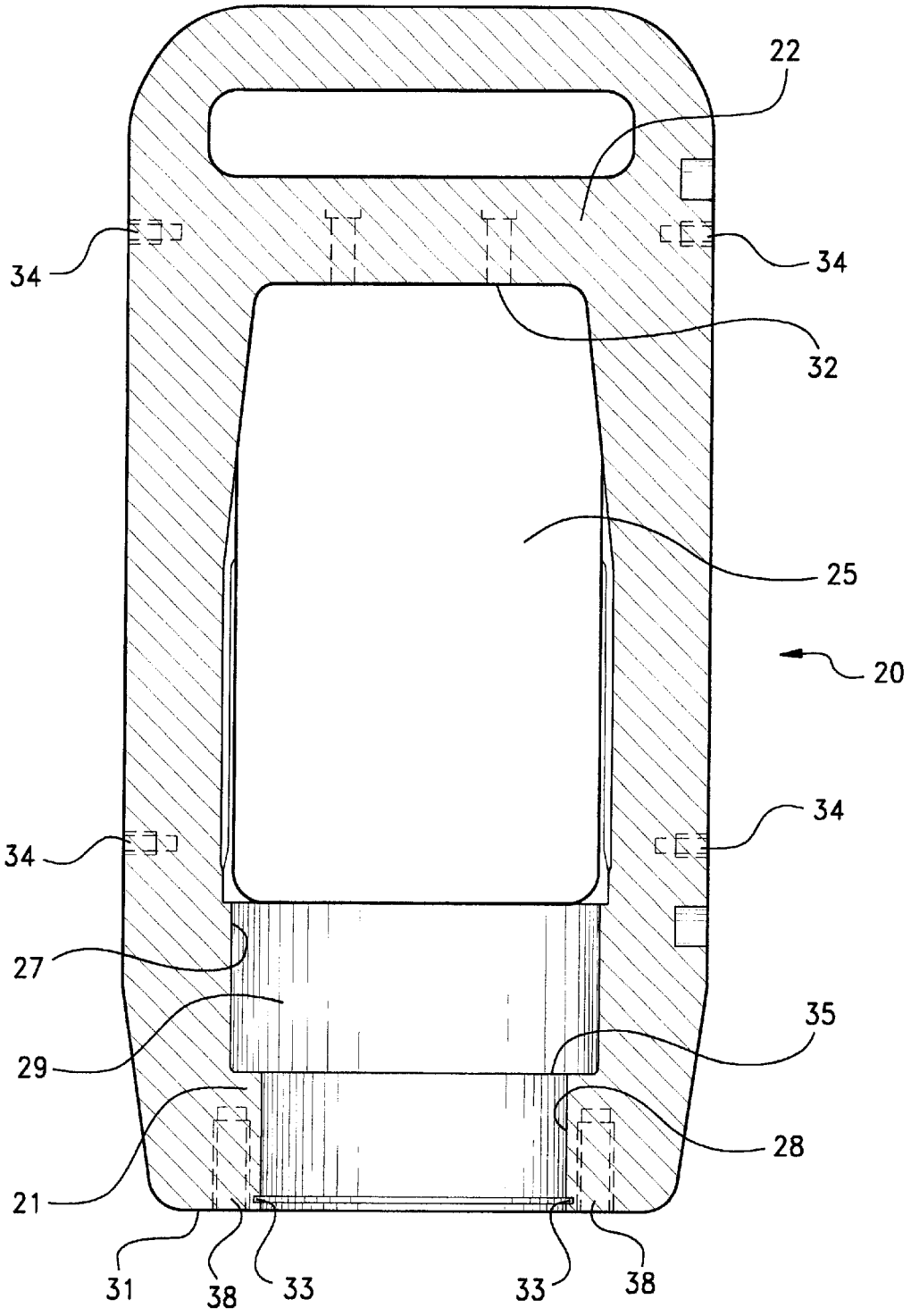
FIG. 4 is a front, cross-sectional view of the crimper housing, taken along line 4—4 of FIG. 3.

Referring to FIG. 2, crimper housing 20 is comprised of a one-piece, generally die-cast construction, preferably made of aluminum or a similar light weight material, having four sides that surround a central opening 25. In the alternative, crimper housing 20 can be made of a non-metallic material, preferably filled or unfilled thermoplastic and thermoset plastics, or a similar material. These four sides of crimper housing 20 include an apertured base portion 21, a solid upper portion 22, a solid first side 23, and a solid second side 24. Base portion 21 includes a cylindrical cavity 29 centrally aligned with the longitudinal axis of crimper housing 20. Cavity 29 extends from an upper surface 30 to a flat, lower surface 31 of base portion 21. Central aperture 27 (as shown in FIG. 4) provided in surface 30, and aperture 28 (as shown in FIG. 3) provided on base portion lower surface 31, define the outer periphery and the longitudinal extent of cavity 29. Apertures 38 are provided in base portion lower surface 31 for receiving fasteners (not shown) for affixing a base mounting plate such as 110, 114, and 118 (discussed below) thereto. Located on the opposite side of central opening 25 from base portion 21 is upper portion 22. Upper portion 22 includes at least one aperture 32 (as shown in FIGS. 3 and 4) in the surface adjacent central opening 25 for receiving fasteners in order to affix a hydraulic cylinder 40, to be discussed below.

Figure 5:
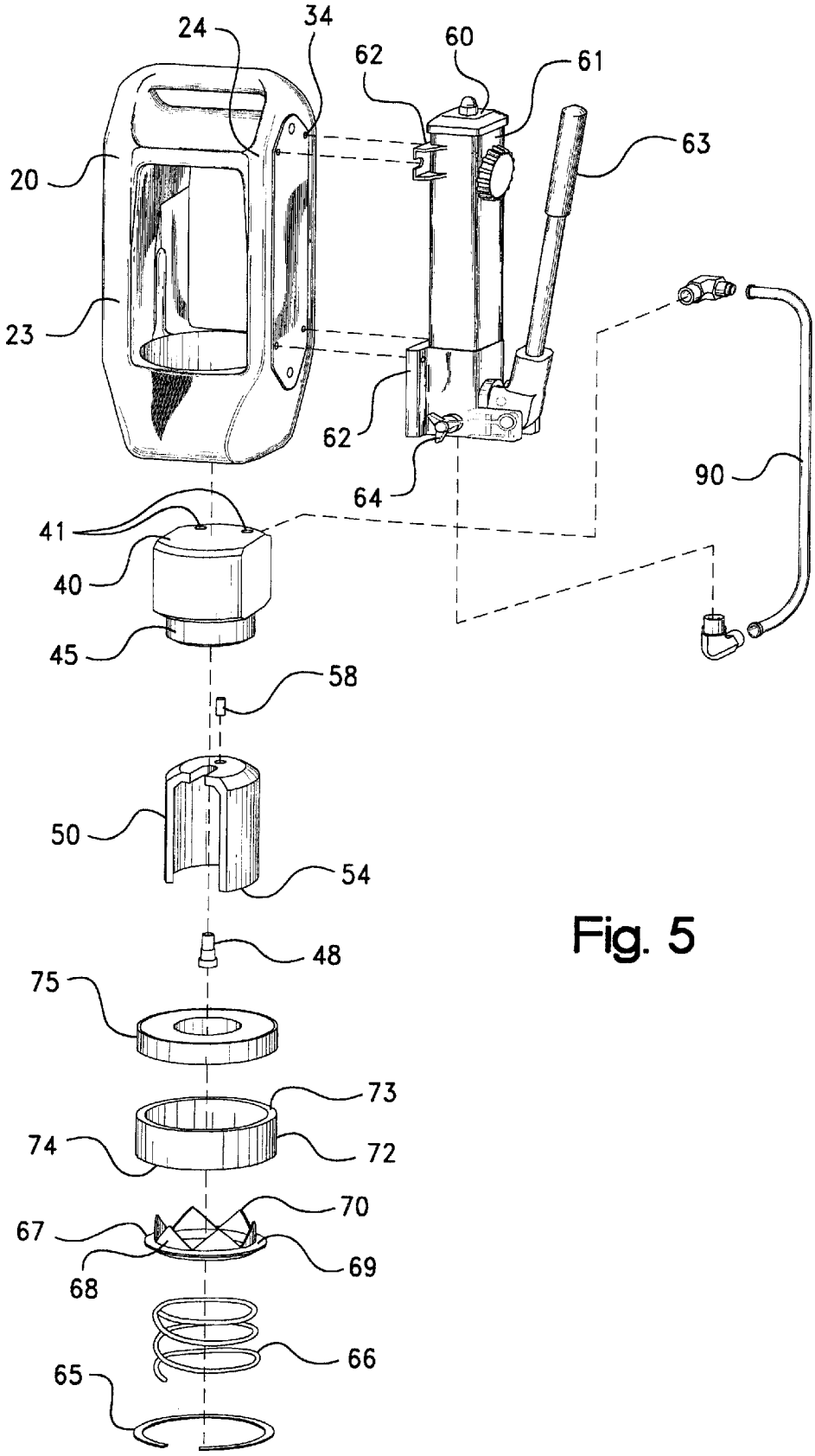
FIG. 5 is an exploded view of the portable crimping device, including the crimper housing, cylinder, piston, die pusher, crimping componentry, hydraulic pump, handle, and conduit.

First side 23 and second side 24 of crimper housing 20 are both parallel to the longitudinal axis of crimper housing 20. The outer surfaces of both sides 23 and 24 are generally flat and contain one or more apertures 34, or mounting holes, for receiving fasteners (not shown) for affixing hydraulic pump 60 (as shown in FIG. 5), or for affixing a side mounting plate 110 (discussed below) thereto. Hydraulic pump 60 can be affixed to either of sides 23 or 24, depending on the user's preference.

A carrying handle 36 is provided on the opposite side of upper portion 22 from central opening 25. Handle 36 extends laterally from first side 23 to second side 24. Handle 36 enables the user to conveniently grasp, handle and thereby transport crimping device 10 to any location where the crimping of a hose assembly is required.

Figure 6:
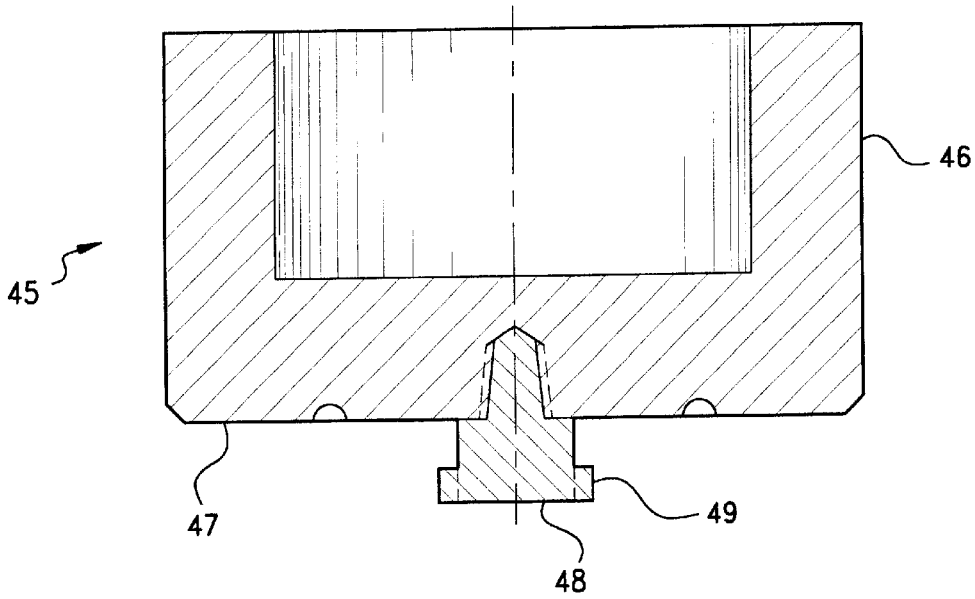
FIG. 6 is a front, cross-sectional view of the symmetrical piston.

Referring to FIG. 5, the componentry of hand-held crimping device 10 is shown in an exploded fashion. Hydraulic cylinder 40 includes at least one aperture 41 on its upper surface that is capable of being aligned with the at least one aperture 32 in upper portion 22 of crimper housing 20 (as shown in FIG. 4). Cylinder 40 thus can be attached to crimper housing 20 via the use of a connecting fastener, not shown, into these aligned apertures. As best seen in FIG. 6, piston 45 has a cylindrical outer surface 46 that merges into a bottom portion 47. The outer diameter of piston 45 is dimensioned for a fluid tight movable relationship with the inside diameter of cylinder 40. Extending from the center of piston bottom portion 47 is a removable knob extension 48 having an outwardly directed shoulder 49 protruding from the knob periphery. If desired, knob extension 48 may be integral with piston bottom portion 47 in the manner shown in FIG. 6.

Figure 7:
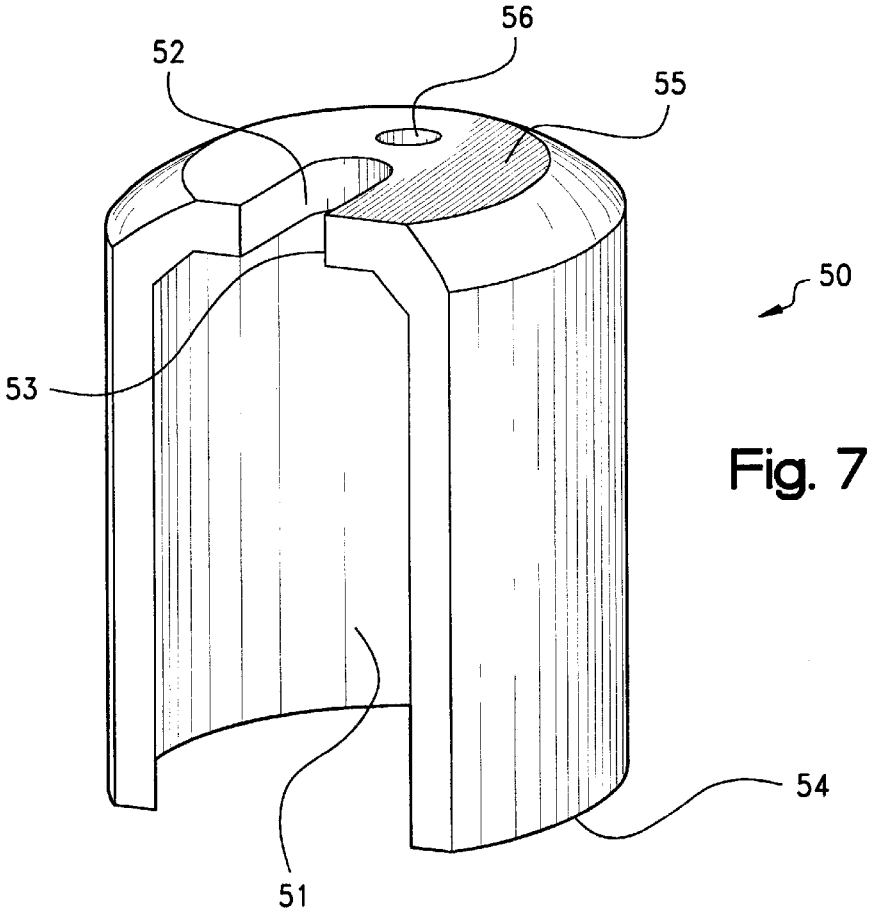
FIG. 7 is a top, perspective view illustrating the die pusher.

Referring to FIG. 7, die pusher 50 consists of a generally cylindrical hollow member having a frontal opening 51 in the forward peripheral portion thereof. Die pusher 50 includes a top portion 55, with a slot 52 that extends from the frontal face to the central axis, and a flat lower edge 54. A recess 53 in slot 52 is provided in order to receive shoulder 49 of piston knob extension 48. Threaded aperture 56 extends through top portion 55 and is dimensioned so that a detent 58 (as shown in FIG. 5) can be received within. Detent 58 ensures that die pusher 50 does not shift when die pusher's 50 central axis is aligned with knob 48.

Referring to FIGS. 4 and 5, base portion 21 of crimper housing 20 has a counterbore 33 or radial recess machined in the inner surface thereof adjacent to central aperture 28. Retaining ring 65 is adapted to fit within counterbore 33. A spring 66 rests on top of and its lower end is held in place by retaining ring 65. A die separator 67 is situated on top of spring 66 and consists of a tubular portion 68 integral with a generally flat, elongated mounting portion 69 that rests on top of spring 66. Die separator 67 is preferably a one-piece structure formed of a rigid plastic material. The upper edge of tubular portion 68 is comprised of a series of intersecting angled surfaces 70 forming generally triangular shaped, axially extending, projections for support of a die segment assembly 80, shown in FIG. 8, which will be discussed below.

Figure 8:
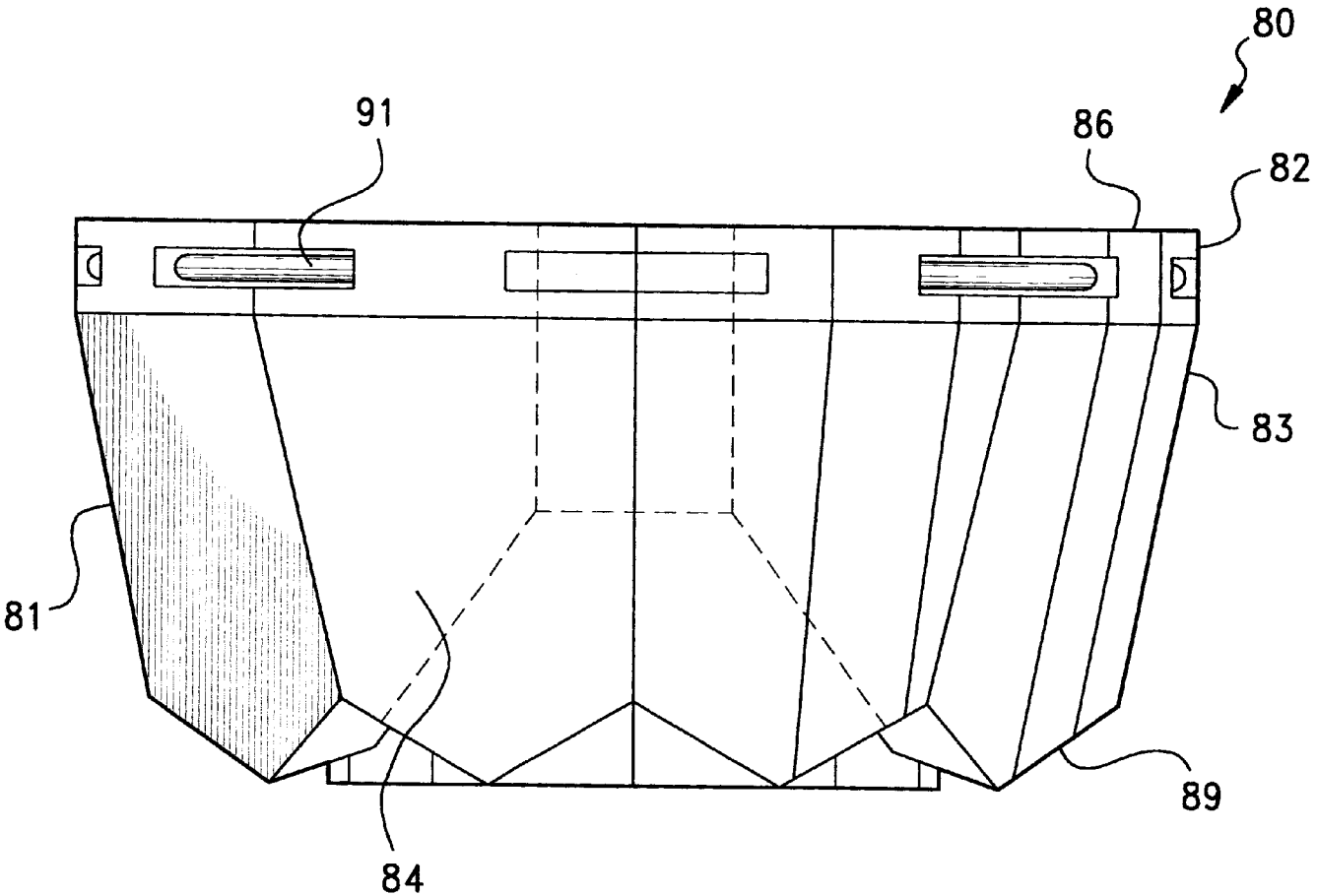
FIG. 8 is a frontal view of the symmetrical, circular die segment assembly shown in a closed position when contracted in the die bowl.

A die bowl 72 is located on top of an inwardly directed annular ridge 35 (FIG. 4) that protrudes into cavity 29 along the entire circumference of the inner surface of base portion 21. Die bowl 72 has a cylindrical outer surface and a tapered interior surface (not shown). The taper of the interior surface is substantially equal to that of the outer surface 81 of die segment assembly 80, as shown in FIG. 8. Angled surfaces 70 of die separator 67 project into the inside of die bowl 72. The top surface of elongated die separator mounting portion 69 contacts a lower surface 74 of die bowl 72. The top peripheral surface 73 of die bowl 72 receives a lower annular surface (not shown) of a die ring 75. Die ring 75 has generally flat annular upper and lower surfaces. The inner diameter of die ring 75 is dimensioned such that a hose fitting with an angled end can fit therethrough. As is well known in the art, the height of die ring 75 varies depending on the desired crimp diameter of the fitting.

Figure 9:
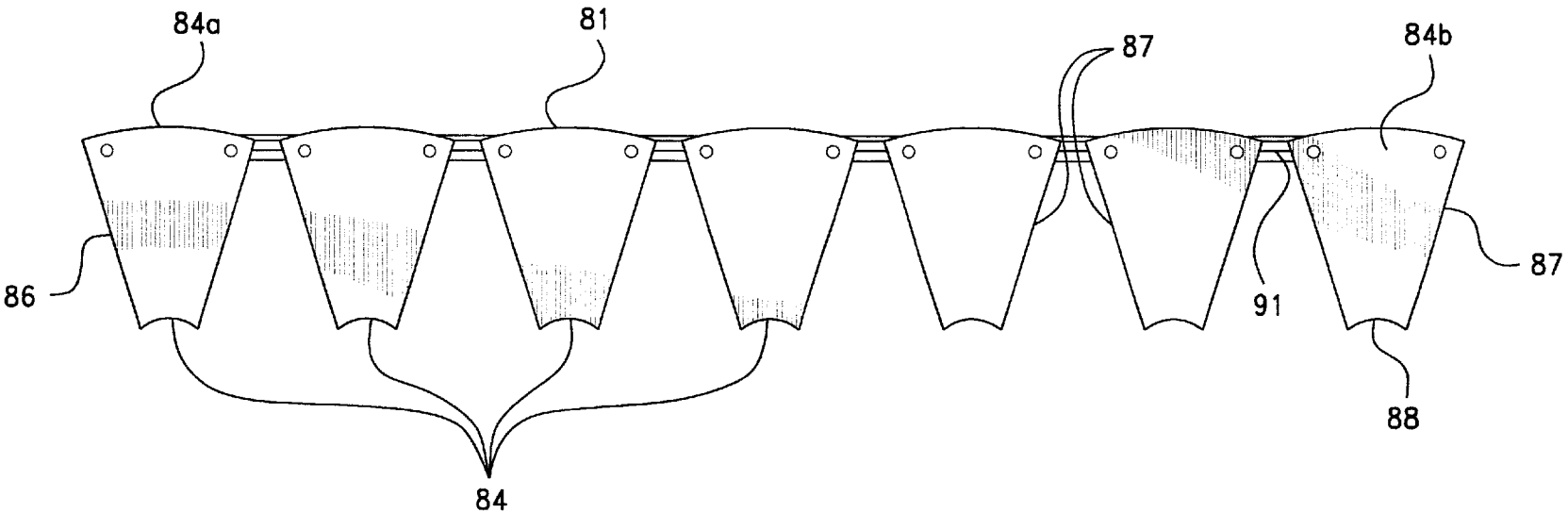
FIG. 9 is a plan view of the die segment assembly, removed from the die bowl shown in an unrolled formation.

Referring to FIGS. 8 and 9, die segment assembly 80 consists of a plurality of generally interconnected identical individual contoured die segments 84. Die segment assemblies 84 are used with mating componentry (e.g. die separator 67) to crimp a specific style of hose fitting. A typical die segment assembly will change depending on the size of the fitting, but the same mating componentry could be used for all sizes of a similar style of hose fittings. An example of a commercially available die segment assembly is shown in U.S. Pat. No. 4,309,892 to Currie, which is assigned to the assignee of the present invention.

Each die segment 84 generally consists of a block of cast steel in a generally pie-shaped configuration. Die segment 84 has a generally flat top portion 86, a pair of flat angled sides 87, an inner curved surface 88 generally conforming, when assembled, to the shape of the hose fitting 95 (as shown in FIG. 14) to be assembled to the hose 97, and a vee-shaped bottom portion 89 angled generally to fit into the receiving angled surfaces 70 (as shown in FIG. 5) of die separator 67. Radial outer surface 81 consists of an upper cylindrical portion 82 and a lower conical portion 83. Lower conical portion 83 is tapered in a manner to match the taper of the interior surface of die bowl 72.

Each die segment 84 is connected to an adjacent die segment 84 by means of an intermediate rigid link 91. When die segment assembly 80 is in its closed or working position, as is best seen in FIG. 8, the two then-adjacent end die segments 84*a*, 84*b* are not linked together, as is best seen in FIG. 9, and thus form the first die segment 84*a* and the last die segment 84*b*, with intermediate die segments 84 therebetween together forming die segment assembly 80 in a manner well known in the prior art.

Referring again to FIG. 5, hydraulic pump 60 can be attached to crimper housing 20 on the outer surface of either first side 23 or second side 24. Apertures on two pump mounting plates 62 align with apertures 34 on first 23 or second side 24 for attachment purposes. Hydraulic pump 60 includes a fluid reservoir located within a cylinder 61. Cylinder 61 contains a movable piston (not shown) which can be moved when an attached handle 63 is manually pivoted relative to cylinder 61. Movement of the piston within cylinder 61 creates a pressurized fluid flow from the fluid reservoir to a conduit 90 that links hydraulic pump 60 to hydraulic cylinder 40. A pressure relief knob 64 is supplied at one end of cylinder 61 in order to relieve the built-up pressure with cylinder 61.

Figure 10:
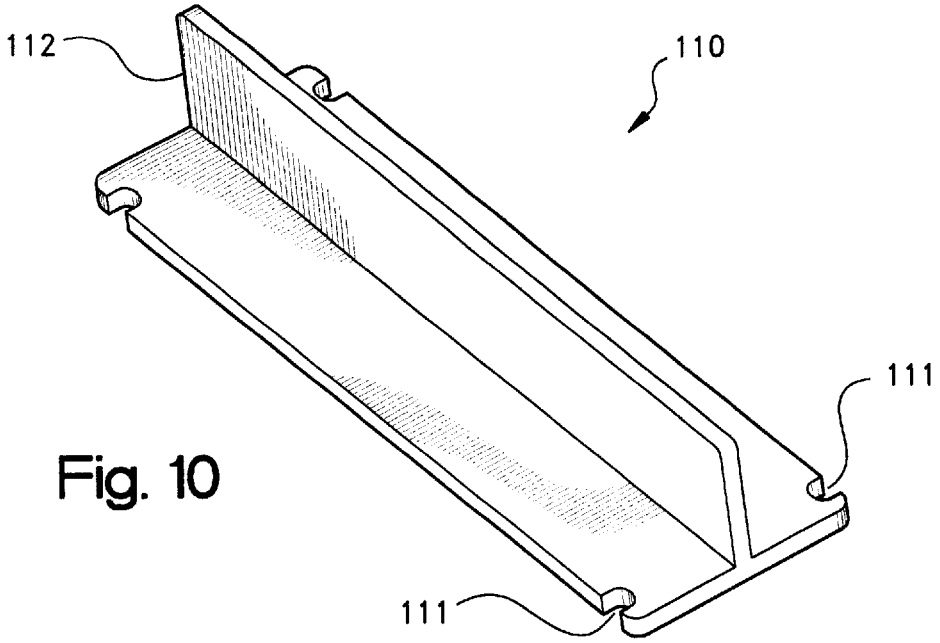
FIG. 10 is a perspective view of a side mounting plate
Figure 11:
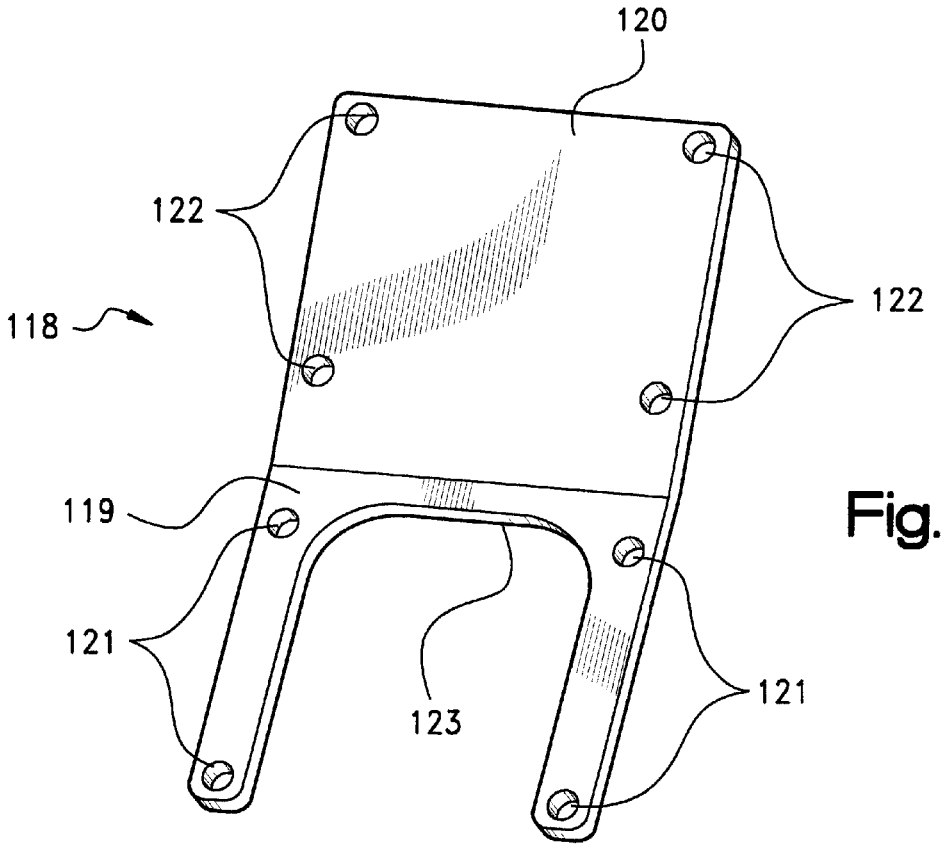
FIG. 11 is a perspective view of a base mounting plate used for affixing the crimper housing to a flat surface.
Figure 12:
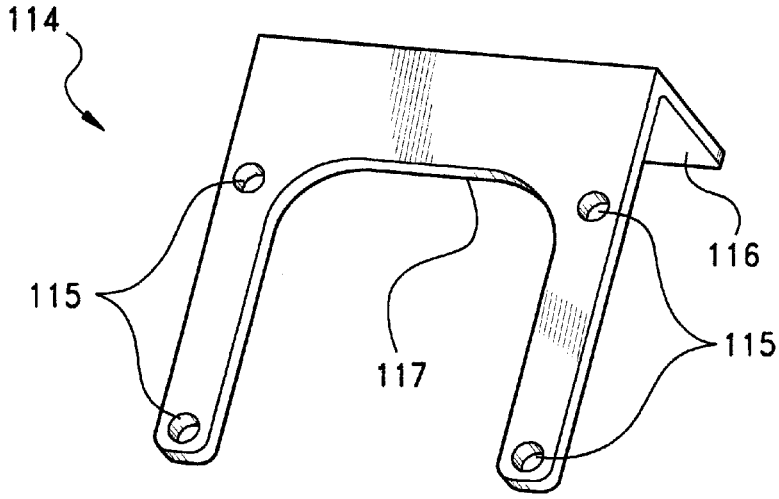
FIG. 12 is a perspective view of another embodiment of a base mounting plate.

Referring to FIGS. 10, 11, and 12, mounting plates, 110, 118 and 114, respectively, are provided for attachment to crimper housing 20. As shown in FIG. 10, side mounting plate 110 has four apertures or cutouts 111 that align with apertures 34 on one of crimper housing sides 23 or 24 (as shown in FIG. 4). Fasteners (not shown) are received in both sets of apertures, 111 and 34, for affixing side mounting plate 110 to crimper housing 20. Apertures 34 are also used for attaching hydraulic pump mounting plate 62, so, for example, if hydraulic pump 60 is attached to crimper housing first side 23, then side mounting plate 110 can be attached to crimper housing second side 24. Side mounting plate 110 has an intermediate lateral extension 112 that extends outwardly from crimper housing 20. As will be discussed in greater detail below, a user of portable crimping device 10 can use a fastening mechanism, such as a vise, for example, (not shown) to clamp mounting plate extension 112 during the crimping process.

As shown in FIG. 11, base mounting plate 118 is designed for attachment of crimper housing 20 to another, preferably flat, object, for example a horizontal table (not shown). Base mounting plate has a first portion 119 that can be attached to the base portion lower surface 31 and a second portion 120 that can be attached to another object. First portion 119 has a set of apertures 121 that align with crimper housing base portion apertures 38 (as shown in FIG. 3). Fasteners (not shown) are used to affix base mounting plate 118 onto base portion lower surface 31. Second portion 120 has a set of apertures 122 that receive fasteners that affix second portion 120 to another object, for example a horizontal table. First portion 119 further has an inner edge 123 that is aligned with central aperture 28 on base portion lower surface 31.

As shown in FIG. 12, base mounting plate 114 is also designed for attachment onto base portion lower surface 31. Base mounting plate 114 has a set of apertures 115 that align with apertures 38 (as shown in FIG. 3). Fasteners (not shown) are used to affix base mounting plate 114 onto base portion lower surface 31. An angled extension 116 extends from plate 114 at any predetermined angle. Base mounting plate 114 has an inner edge 117 that is aligned with central aperture 28 on base portion lower surface 31. A user of portable crimping device 10 can use any desired fastening mechanism, such as, a vise, for example, (not shown) to clamp extension 112 during the crimping process.

Figure 13:
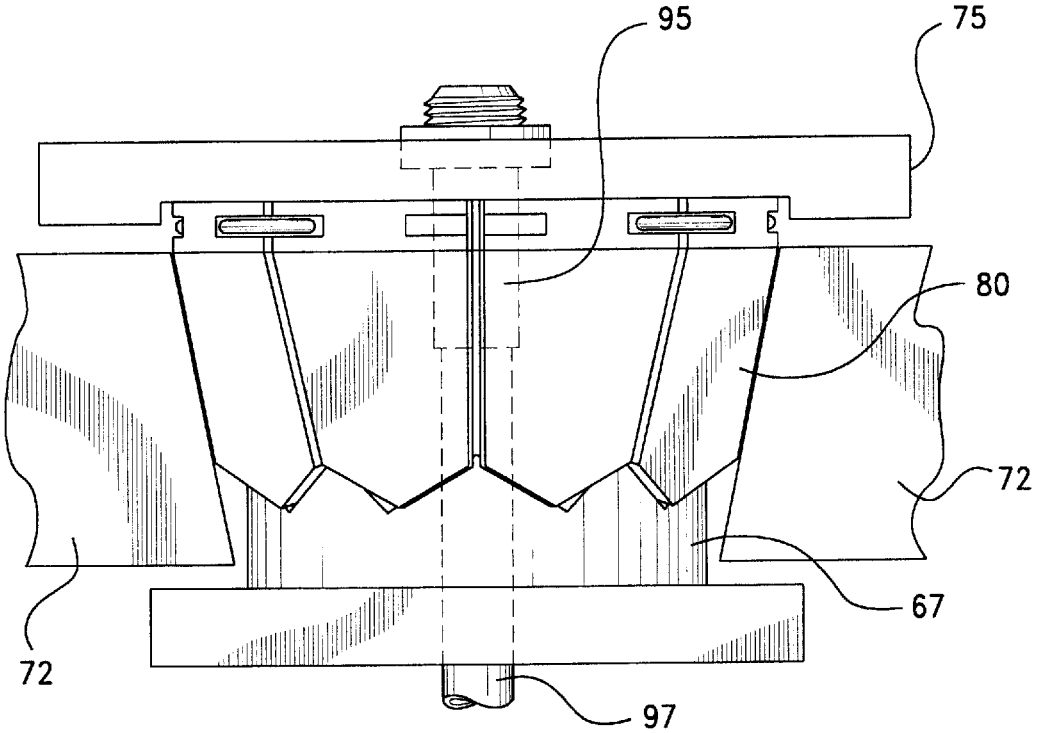
FIG. 13 is a side view showing the die segment assembly in a contracted position, removed from the crimper housing.

The operation of the portable, and preferably, hand held crimping device 10 will now be described. With all of the componentry (as shown in FIG. 5) and die segment assembly 80 (as shown in FIG. 8) assembled within crimper housing 20, portable crimping device 10 is ready to crimp a hose fitting. Referring to FIGS. 4, 5 and 13, a precrimped hose assembly, consisting of a hose fitting 95 and a hose 97 (FIG. 14) is inserted into base portion cavity 29 of portable crimping device 10 through the lower surface 31. Since die pusher 50 is not yet in contact with die ring 75, die segment assembly 80 is in a relaxed at-rest position and the precrimped hose assembly will fit through the center of die segment assembly 80.

The fabricator of the hose assembly will repeatedly pivot handle 63 relative to cylinder 61, thereby building up pressure within cylinder 61 and conduit 90. This pressure will cause movement of spring-loaded piston 45 within cylinder 40. Piston 45, and attached die pusher 50, move longitudinally and die pusher lower edge 54 contacts the upper annular surface of die ring 75, causing the latter to also move longitudinally. Die ring 75, resting on top of die segment assembly 80, forces die segment assembly 80 into the tapered interior of die bowl 72. Die segment assembly 80 constricts radially inwardly and die segment inner cylindrical surface 88 engages and compresses fitting 95 onto hose 97 until the lower surface of die ring 75 bottoms out on die bowl 72. The inward radial compression of fitting 95 produces a predetermined desired crimp diameter. The height of die ring 75 determines the longitudinal distance that piston 45, die pusher 50, and die ring 75 travels. The greater the height of die ring 75, the shorter the travel distance. The greater the travel distance, the further die segment assembly 80 will travel within tapered die bowl 72. The greater the longitudinal travel distance of die segment assembly 80, the more it will be radially inwardly compressed.

During the crimping process, forces from the radial contraction of die segment assembly 80, and opposing forces from the crimping of the hose fitting cause stresses within integral crimper housing 20. Due to the one-piece, unitary construction of crimper housing 20, these forces are distributed throughout the four sides. Since the four sides are not fastened to each other in the columnar construction of the prior art, stresses are not localized in any specific area, e.g. a link between the side wall and base, thus preventing any stress damage to crimper housing 20.

After the crimping operation has been completed, piston 45 typically needs to be fully retracted in order to remove the crimped hose assembly, die segment assembly 80, die separator 67, or die bowl 72. A full retraction is needed since the available space inside central opening (as shown in FIG. 2) is limited, and die pusher 50 must be fully displaced from die ring 75 in order to remove the above mentioned componentry. When retracting piston 45, attached die pusher 50 loses contact with the upper annular surface of die ring 75. This allows die segment assembly 80 to open up diametrically, thus providing room for the crimped hose and fitting assembly to be removed. Retraction of piston 45 is achieved by actuating pressure relief knob 64, thus relieving pressure from hydraulic pump 60. Since piston 45 is spring loaded it retracts within hydraulic cylinder 40 proportionally to the amount of pressure being relieved from hydraulic pump 60. A full retraction of piston 45, which may take a significant amount of time especially during multiple crimping operations, can be avoided with the present invention. Since die pusher 50 is removable from piston 45, only a slight retraction of piston 45 is needed in order to remove the above mentioned componentry. Instead of a full retraction, piston 45 can be slightly retracted to the location where die pusher 50 is no longer in immediate contact with die ring 75. At this location, die pusher 50 can slide off knob 48, as best shown in FIG. 6, and space is then provided inside central opening 25 in order to remove the componentry. With this abbreviated retraction of piston 45 and subsequent removal of die pusher 50, assembly cycle time is significantly reduced.

Referring to FIGS. 1 and 2, during the crimping operation, the longitudinal axis of portable crimping device 10 can be oriented either horizontally or vertically. The flat lower surface 31 of crimper housing 20 allows portable crimping device 10 to be positioned vertical with lower surface 31 resting on another horizontal, flat surface (e.g. a worktable). The flat outer surfaces of first and second sides, 23 and 24, allow portable crimping device 10 to be positioned with its longitudinal axis in a horizontal position during the crimping operation. Depending on which side of crimper housing 20 hydraulic pump 60 is affixed, the opposite side can rest on another horizontal, flat surface. Since, as noted, die pusher 50 does not have to fully retract, the close proximity of die pusher 50 to die ring 75 will prevent the crimper componentry, i.e. die ring 75, die segment assembly 80, and die separator 67, from shifting or falling out of cavity 29. The outer, flat surfaces of apertured base portion 21, first solid side 23, and second solid side 24 gives the operator much flexibility on any flat surface without compromising the crimping accuracy.

Likewise, the use of mounting plates, 110, 114, and 118, as shown in FIGS. 10–12, provide the operator with even greater crimping flexibility. Base mounting plate 118 allows the operator to affix portable crimping device to any flat surface in any orientation. For example, with first portion 119 attached to base portion lower surface 31, second portion 120 can be attached to an edge of a flat, horizontal table. In this arrangement, the longitudinal axis of portable crimping device 10 would be substantially vertical, with the lower surface 31 of base portion 21 hanging off the table. This arrangement would allow the operator accessibility to the lower surface of cavity 29 in base portion 21 in order to insert and remove the hose assembly. In another arrangement, second portion 120 could be attached to a vertical wall, positioning the longitudinal axis of portable crimping device 10 in a horizontal orientation. Due to its light weight and compact design, portable crimping device 10 can be rigidly held in this position. As mentioned above, since die pusher 50 does not have to be fully retracted, it will contain the crimper componentry when portable crimping device is in this orientation.

Side mounting plate 110 allows the operator to perform the crimping operation when a flat surface is not available. Side mounting plate 110 can be affixed to the outer surface of either the first or second sides 23, 24 of crimper housing 20. As previously mentioned, side mounting plate apertures 111 align with crimper housing apertures 34 and fasteners are used to affix side mounting plate 110 to crimper housing 20. When attached, intermediate extension 112 protracts from crimper housing 20. As previously noted, the crimper operator can use an attachment device, for example, a vise (not shown), for securing portable crimping device 10 so that crimping device 10 is stabilized during the crimping operation. For example, a hose assembly may fail in operation and a replacement assembly may have to be fabricated at the location of use. Many times this location will not have a flat surface for locating the portable crimping device 10. Thus the operator can attach a vise to any available non-flat surface, and then secure intermediate extension 112 in the vise. Since portable crimping device 10 can be utilized in any orientation, a hose assembly can be properly crimped even when a flat surface is not available.

Like the previously noted side mounting plate 110, base mounting plate 114 can also be used when a flat surface is not available. Base mounting plate 114 is mounted on base portion lower surface 31 similar to base mounting plate 118 and provides the same flexibility as side mounting plate 110. Angled extension 116 protracts from crimper housing 20 when attached, and an operator can use a vise as previously detailed in order to stabilize portable crimping device 10 so that crimping operations can be performed.

As noted above, portable crimping device 10 can be utilized not only as a workplace-mounted unit, but also in the field, for example on a piece of machinery, where a flat mounting surface is unavailable. Portable crimping device 10 can also be operated in any angular orientation. Thus, regardless of the location for the replacement hose assembly, portable crimping device 10 can be used. Also, due to its compact size and light weight, 37 lbs. with added componentry, crimping device 10 can be transported to locations where typical portable crimping machines could not. An example of such a location is a truck boom. Typically the boom of a truck is hydraulically or pneumatically operated. Hose assemblies are used as conduits for the required pressurized fluid. These assemblies are typically drawn through orifices smaller in diameter than those of the hose fittings. Therefore, the crimping of the hose fitting must take place at the port location of the fitting attachment. When a hose assembly on the truck boom fails, the operator can hand carry portable crimping device 10 up a ladder to the hose assembly location, secure an attachment device to the boom and affix crimping device 10 thereto, with a mounting plate, if required, and operate portable crimping device 10 at that specific location and any angular orientation.

As previously noted, crimper housing 20 is compact, preferably having the following approximate dimensions: 15" height, 7" width and 6" depth. Due to this compact, one-piece or unitary design of crimper housing 20, the center of gravity thereof is low enough to provide an even balance to the portable crimping device 10 when the additional componentry, e.g. cylinder 40, piston 45, die bowl 72, etc., is attached. Therefore it is unlikely that portable crimping device 10 will tip over during operation. In the event that portable crimping device 10 is dropped, the compact, durable unitary housing 20 can withstand forces that would typically damage a prior art columnar portable crimper. Crimper housing 20 is not subject to misalignment from the external forces and, due to its one-piece unitary construction, there are no linkages, or columns in housing 20 that can act as stress/strain fracture points from such external forces.

Figure 15:
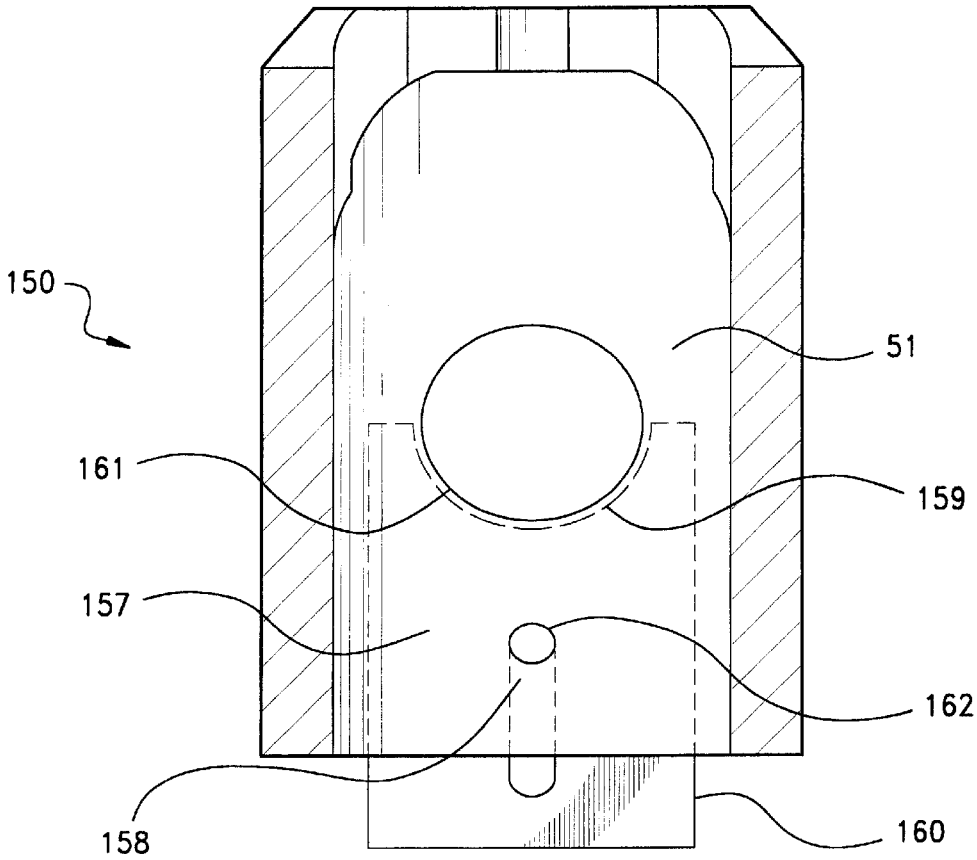
FIG. 15 is a side view of the die pusher frontal opening, showing a further embodiment having a hose cutting mechanism (partially shown in dotted lines) removably attached to the die pusher.

Referring to FIG. 15, a second embodiment is shown wherein the die pusher 150 has a removable cutting mechanism 157, preferably made of a hardened tool steel, attached thereto. Die pusher 150 takes the same general form as that previously described in FIG. 7, except that the side opposite opening 51 has two apertures, 161 and 162. Aperture 161 is generally circular in shape and has a larger diameter than aperture 162. Cutting mechanism 157 is slidably attached to die pusher 150 with a fastener, not shown, which fits through a slot 158 provided within cutting mechanism 157 and is radially retained in aperture 162. Cutting mechanism 157 has a sharp cutting edge 159 at its top portion and a bottom portion 160 that extends below die pusher 150. Cutting mechanism 157 may be spring loaded (spring not shown per se), and while in its relaxed position, bottom portion 160 protrudes below the lowest portion of die pusher 150 at least the distance of the diameter of aperture 161, and cutting edge 159 is positioned just below the bottom portion of aperture 161.

During the cutting operation, the hose is positioned through aperture 161 so that the prescribed cutting length location, normally indicated by an indicia mark on the hose, is coplanar with cutting edge 159. In the same manner as described above (and shown in FIG. 5), the fabricator of the hose assembly will repeatedly pivot handle 63 relative to cylinder 61, thereby building up pressure within cylinder 61 and conduit 90. This pressure will cause movement of spring-loaded piston 45 within cylinder 40. Piston 45, attached die pusher 50, and attached cutting mechanism 157 move longitudinally and cutting mechanism bottom portion 160 contacts the upper annular surface of die ring 75. Cutting mechanism 157 is guided by the fastener, not shown, within slot 158 and moves upwardly until the bottom portion of slot 158 comes in contact with the fastener. During this movement, cutting edge 159 comes in contact with and thereafter severs the hose placed through aperture 161.

Cutting mechanism 157 is particularly useful when an operator needs to cut a hose at the job site. Typically a hose would have to transported to a fabrication site when a cutting tool is used to cut the hose at a prescribed length. With cutting mechanism 157, a hose can be cut at the job location, thus saving time and expense.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. A portable apparatus for crimping a hose fitting to a hose, comprising:

a unitary frame having a longitudinal axis and four sides surrounding an open middle section, wherein said four sides are comprised of a base, located at one end of said middle open section, perpendicular to the longitudinal axis, and having a receiving opening longitudinally extending through said base; a top portion, perpendicular to the longitudinal axis, located at the opposite end of said open middle section from said base; a first side parallel with the longitudinal axis and perpendicular to said base and said top portion; and a second side, parallel with said first side, located at the opposite side of said open middle section from said first side, said first and second sides serving to interconnect said base and said top portion;

a cylinder, removably attached to an inner surface of said top portion, having a piston which is movable longitudinally from a first position to a second position within said cylinder;

a pusher, removably attached to said piston;

a removable annular die bowl located within said base receiving opening;

an annular die separator, having a base portion located adjacent to said die bowl and a series of angular extensions protruding from said base portion, positioned within said die bowl;

an annular die segment assembly removably positioned on top of said die separator, said die segment assembly including a plurality of die segments which are radially movable relative to said base receiving opening, said die segments having a generally flat upper portion and an angular lower portion adapted to mate with said angular extensions of said annular die separator; and an annular die ring disposed between said pusher and said die segment assembly.

2. The apparatus of claim 1 wherein the unitary frame has mounting holes on at least one of the outer surfaces of said first and second side for attaching a power unit.

3. The apparatus of claim 1 wherein said unitary frame includes a handle located longitudinally outwardly of said top portion for manual lifting purposes.

4. The apparatus of claim 3 wherein said handle is integral with said unitary frame.

5. The apparatus of claim 1 wherein said unitary frame includes multiple support surfaces enabling said longitudinal axis to be angularly positioned either horizontally or vertically.

6. The apparatus of claim 1 wherein at least one of said base, said first side and said second side of said unitary frame has a generally flat outer surface.

7. The apparatus of claim 1 wherein said top portion, said first side and said second side are comprised of essentially solid surfaces.

8. The apparatus of claim 1 wherein said unitary frame includes blind mounting holes for attaching at least one side and/or bottom mounting plate.

9. The apparatus of claim 8 wherein said mounting holes are located on the outer surface of at least one of said first and second sides.

10. The apparatus of claim 8 wherein said mounting holes are located on the outer surface of said base portion.

11. The apparatus of claim 1 wherein said apparatus can be oriented in any angular position during the crimping of the hose fitting to the hose.

12. The apparatus of claim 1 wherein said unitary frame can be placed on one said first or second sides during the crimping of the hose fitting to the hose.

13. The apparatus of claim 1 wherein the longitudinal axis of said unitary frame is generally horizontally positioned during the crimping of the hose fitting to the hose.

14. The apparatus of claim 1 wherein the longitudinal axis of said unitary frame is generally vertically positioned during the crimping of the hose fitting to the hose.

15. The apparatus of claim 1 wherein said unitary frame takes the form of a light metal casing.

16. The apparatus of claim 1 wherein said unitary frame is formed from a non-metallic material.

17. The apparatus of claim 1 wherein said unitary frame is comprised of an aluminum alloy casting.

18. The apparatus of claim 1 wherein said pusher includes a cutting mechanism, principally used for cutting the hose.

19. An apparatus for crimping a hose fitting to a hose, comprising:

a one-piece, four-sided, hollow, generally rectangular body having a cavity, disposed within one side of said body, for receiving crimping componentry;

a removable cylinder, attached to the side of said body opposite said cavity, having a piston movable within from a first position to a second position;

a die pusher, removably attached to said piston;

a removable annular die bowl located in said cavity;

an annular die separator having an upper portion positioned within said die bowl;

an annular die assembly having a lower portion removably positioned on said upper portion of said annular die separator, said die assembly having a plurality of connected die segments which are movable radially of said cavity; and an annular die ring positioned between said pusher and said die assembly.

20. The apparatus of claim 19 wherein said one-piece rectangular body includes an integral handle disposed longitudinally outwardly thereof on the side of said body opposite said cavity.

21. The apparatus of claim 19 wherein said generally rectangular body includes multiple outer support surfaces thus enabling the longitudinal axis of said body to be angularly positioned either horizontally or vertically during the crimping operation.

22. The apparatus of claim 21 wherein said multiple support surfaces include mounting holes for attaching a side and/or bottom mounting plate for further attachment to any mounting surface thus enabling said apparatus to be oriented in any desired angular position during the crimping of said hose fitting to said hose.

23. The apparatus of claim 20 wherein the size and weight of said apparatus are selected to make said apparatus readily portable and capable of being hand-carried to remote locations by a human operator.

24. A unitary housing for attaching and retaining componentry used in the process of crimping a hose fitting onto an end of a hose, said housing having a longitudinal axis and four sides surrounding an open middle section, said four sides being comprised of a base, located at one end of said middle open section, perpendicular to the longitudinal axis, and having a receiving opening longitudinally extending through said base; a top portion, perpendicular to the longitudinal axis, located at the opposite end of said open middle section from said base; a first side parallel with the longitudinal axis and perpendicular to said base and said top portion having a flat outer surface; and a second side, parallel with said first side, located at the opposite side of said open middle section from said first side and having a flat outer surface, said first and second sides serving to interconnect said base and said top portion, wherein said housing can be placed on one of said base and the flat outer surface of either said first side and said second side during said process of crimping of said hose fitting to said hose.

* * * * *